United States Patent [19]

Downey

[11] Patent Number: 4,506,407

[45] Date of Patent: Mar. 26, 1985

[54] RELEASABLE HOLD-OPEN DEVICE FOR A DOOR CLOSER

[75] Inventor: William L. Downey, Peru, Ill.

[73] Assignee: Schlage Lock Company, San Francisco, Calif.

[21] Appl. No.: 514,636

[22] Filed: Jul. 18, 1983

[51] Int. Cl.[3] ..... E05F 15/20

[52] U.S. Cl. ..... 16/48.5; 16/49; 16/320; 16/DIG. 9; 16/DIG. 10; 16/DIG. 14; 16/DIG. 17

[58] Field of Search ..... 16/48.5, 49, 51, 52, 16/61, 62, 63, 64, 65, 66, 69, 70, 320, DIG. 9, DIG. 10, DIG. 14, DIG. 17; 292/27, 30, 41, 49, 144, 201

[56] References Cited

U.S. PATENT DOCUMENTS

| | | | |
|---|---|---|---|
| 1,852,609 | 4/1932 | Griffin | 16/DIG. 9 |
| 3,415,562 | 12/1968 | Petersen | 16/49 X |
| 3,729,770 | 5/1973 | Lasier | 16/49 X |
| 3,771,823 | 11/1973 | Schnarr | 16/49 X |
| 3,964,125 | 6/1976 | Tansley | 16/48.5 |
| 4,040,143 | 8/1977 | Lasier et al. | 16/48.5 |
| 4,185,356 | 1/1980 | Kuiralainen et al. | 16/52 |

*Primary Examiner*—Fred A. Silverberg
*Attorney, Agent, or Firm*—Lothrop & West

[57] ABSTRACT

A releasable hold-open device for a spring-impelled, regulated door closer has a door motion follower adapted to be releasably held in a door-open position. An actuator is arranged to retain or release the follower under control of a permanent magnet that can be overcome by an electromagnet.

4 Claims, 8 Drawing Figures

RELEASABLE HOLD-OPEN DEVICE FOR A DOOR CLOSER

BRIEF SUMMARY OF THE INVENTION

For controlling the movement of a hinged door panel mounted to swing relative to a door frame under control of a spring-return door closer, there is a door motion follower releasably held in a selected position by a latch. An actuator for the latch is itself releasably held in a selected position by a permanent magnet. An electromagnet, when energized, overcomes the permanent magnet and releases the actuator to unlatch the follower. The door panel is then under normal control of the door closer itself.

PRIOR ART OF INTEREST

Prior art presently known to the applicant is as follows: U.S. Pat. No. 3,729,770, May 1, 1973, Lasier; U.S. Pat. No. 3,771,823, Nov. 13, 1973, Schnarr; U.S. Pat. No. 3,964,125, June 22, 1976, Tansley; U.S. Pat. No. 4,040,143, Aug. 9, 1977 Lasier et al.

All of the foregoing patents are pertinent to the general field in which the present device is established, but none of them has the same mechanism, mode of operation or results of the current device.

DETAILED DESCRIPTION

Figure 7:
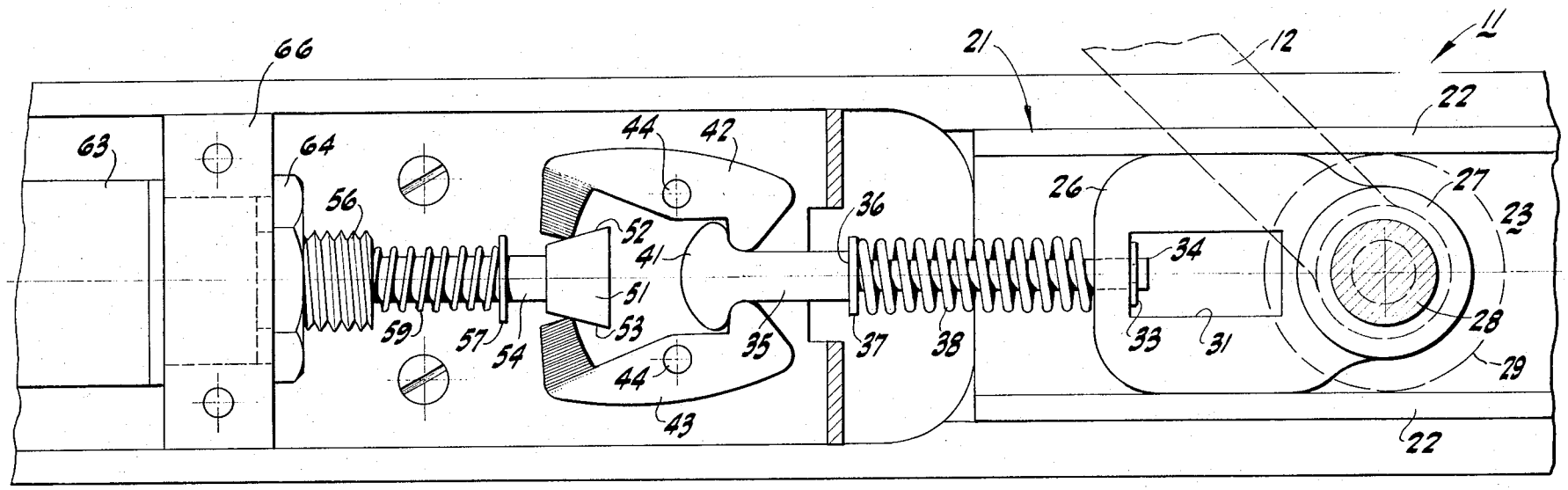
FIG. 7 is a view like FIG. 5, but showing the parts to an enlarged scale.
Figure 1:
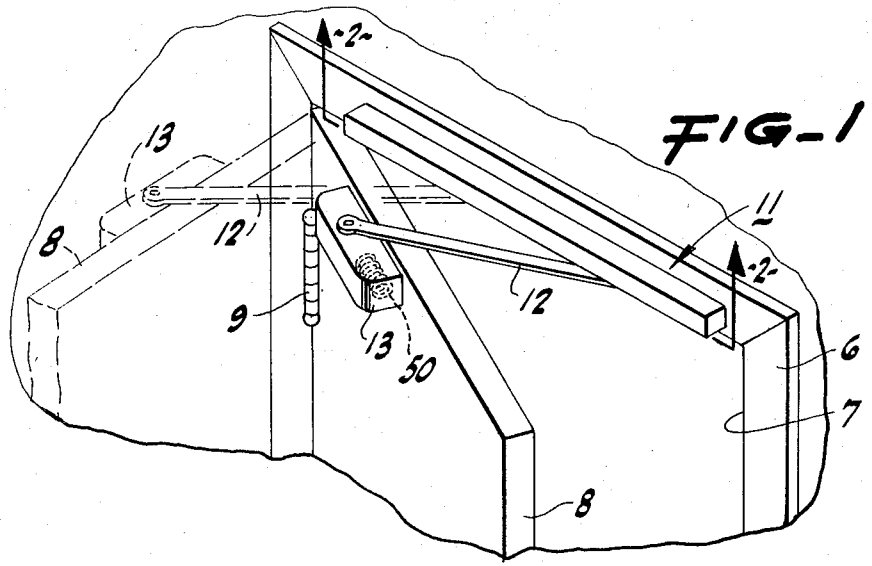
FIG. 1 is an isometric perspective, portions being broken away, of a releasable hold-open device pursuant to the invention installed on a door frame and connected to a door panel hinged thereon, the door panel being in a partially open position.
Figure 8:
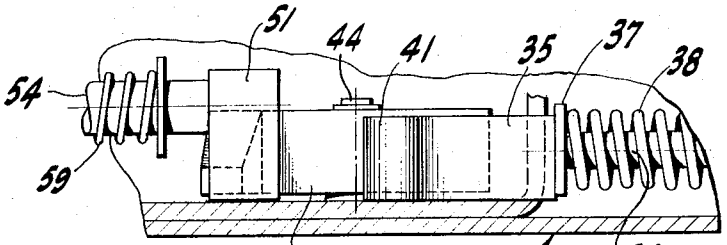
FIG. 8 is a side elevation, with portions broken away, of some of the parts to the same scale as FIG. 7.

One form of the device of the present invention is utilized in connection with a stationary door frame 6 having the customary opening 7 therein adapted to be closed or opened by a swinging door panel 8 mounted on hinges 9 secured to the frame. The closing motion of the manually opened door panel 8 is partly controlled by a controlling mechanism 11 mounted on the frame 6 and having an arm 12 extending to a spring return device 13 having hydraulic door closure restriction. There are many different sorts of spring-actuated, hydraulically regulated door closers effective for use with the remainder of the present structure. The device 13 and its arm 12 are simply typical devices effective so that when the door is released from an open or partially open position the spring-urged door panel returns in a programmed way to and closes in its shut position.

In the present instance, the mechanism 11 of the closer includes a frame 21 having tracks 22 defining in effect a channel 23 extending for a substantial distance along the frame 6. Movable within the channel 23 is a slide 26 mounted for rectilinear sliding and inclusive of an annular boss 27 that can engage an appropriate pivot pin 28 on the arm 12. The pin 28 carries a roller 29 guided by the tracks 22. A stop plate 24 bridges the channel and limits the roller travel. In any case, as the door panel 8 swings relative to the frame and the arm 12 moves under the constraint of the closer mechanism 13, the slide 26 is correspondingly moved to and fro within the inverted channel 23.

Pursuant to the present arrangement, the slide 26 is subject to certain constraints. The slide has a central, generally rectangular opening 31 therein receiving a retainer 33 on the end of a rod 34 secured to a follower 35. Preferably, the follower has a shoulder 36 against which is a washer 37 engaging a spring 38 also abutting the end of the slide 26. With this arrangement, the follower and the rod can move axially for a limited distance and with respect to the slide 26 and be yieldably returned.

One end of the follower 365 has an enlarged or "mushroom" head 41 of laterally rounded contours in order easily to engage and to be engaged by the adjacent end or ends of one or more latch levers 42 and 43. These are substantially identical and each is secured to the frame 21 by its own pivot pin 44 for limited oscillation.

Figure 2:
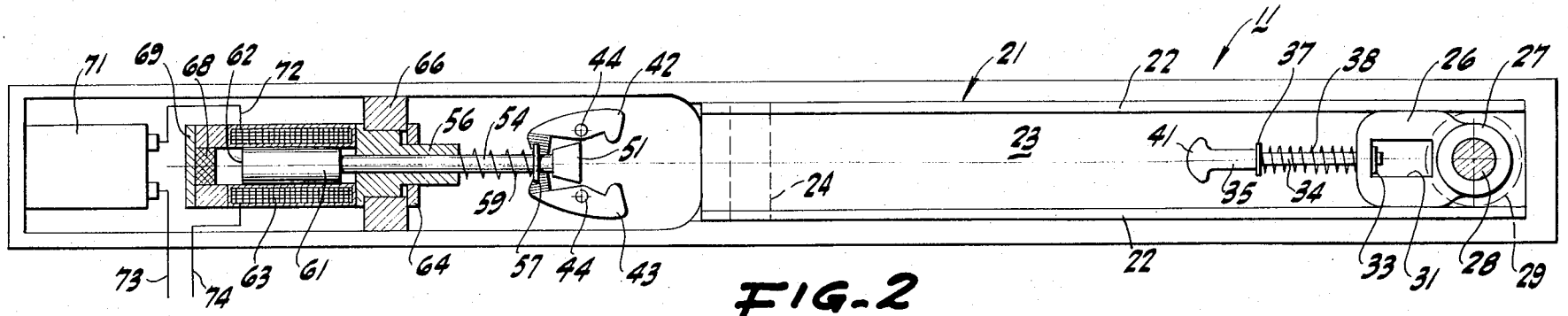
FIG. 2 is a view looking upward from below in a transverse horizontal plane showing the device of FIG. 1 with the parts in their positions with the door panel in door-closed position.
Figure 3:
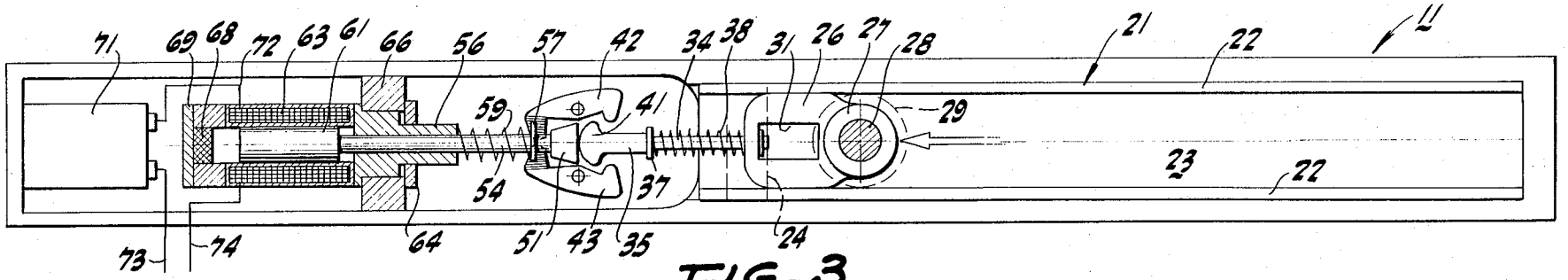
FIG. 3 is a view comparable to FIG. 2 but showing the position of the parts when the door panel is in a nearly open position.

The arrangement is such that if the levers 42 and 43 are free to pivot, the mushroom head 41 can be moved from a right-hand position beyond the levers, as shown in FIG. 2, into abutment with the levers and upon application of light pressure can spread or cam them apart and come to rest between the levers, as shown in FIG. 3.

The levers, however, are not always entirely unrestrained. Adapted to operate between the levers and to operate substantially symmetrically on both of them is a wedge 51 having tapered sides 52 and 53. The wedge is at one end of an actuator rod 54 in general axial alignment with the rod 34 and extends through and is axially movable within a supporting boss or stem 56 fast on the frame 21. A washer 57 is secured in a groove in the rod 54 and acts as abutment for a spring 59 surrounding the rod and of somewhat lesser strength than the spring 38. The left ends of the levers 42 and 43 are beveled or cut away and the wedge is of extra vertical thickness so that, as seen in FIG. 3, for instance, the lever ends can move close together above the displaced actuator rod 54.

The actuator rod 54 passes through the boss 56 and carries a solenoid armature 61. Conveniently, the armature 61 is ferrous and substantially circular cylindrical and has a flat end 62. The armature operates within a solenoid coil 63 supported on the boss 56, and is fixed removably in place by a nut 64 threaded onto the stem 56. The boss abuts and is held by a support plate 66 attached to the frame 21. The solenoid core 61 is axially movable with a substantial travel within the coil 63 but at one end, in an extreme position, is adapted to abut a permanent magnet 68 on a magnet plate 69 forming part of the solenoid mechanism.

With this arrangement, especially as shown in FIG. 2 with the door panel 8 closed, the slider 26 is near an extreme right-hand position in the channel 23 and the spring 38 causes a maximum projection of the mushroom head 41 of the follower 35. At the other end of the assembly, the solenoid coil 63 is deenergized so that the coil spring 59 is fully expanded against the washer 57 and urges the wedge 51 substantially into a central, neutral position between the rocker or latch levers 42 and 43. These, in themselves, are unrestrained.

As the door panel 8 is manually opened, a spring 50 contained within the door controlling mechanism 13, is compressed due to the rotary action of the end of the arm 12 connected to the mechanism 13. The other end of the arm 12 is joined to the slide 26 which is correspondingly moved along the length of the channel 23 toward the levers 42 and 43. The slide 26, as shown in FIG. 3, is moved toward the left far enough to introduce the mushroom head 41 between the spread-apart latch levers. If the levers 42 and 43 are not already spread apart, then the advancing mushroom head 41 cams against the lever forward ends and pivots them apart so that the mushroom head 41 ends in a position as shown in FIG. 3 and substantially against the wedge 51.

If the door panel 8 is manually released from this position, there is no further opening actuation and the normal closer mechanism 13 closes the door panel 8 under control. The spring 50 within the closing mechanism 13 expands causing a rotary motion of the arm 12 which transmits force to the frame 21. This causes the panel 8 to close as the slide 26 moves laterally along the channel 23 away from the levers 42 and 43.

Figure 4:
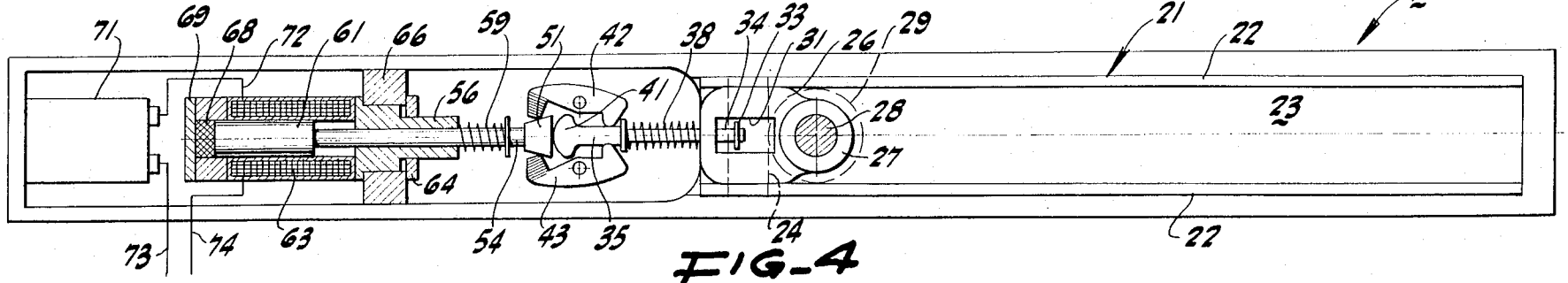
FIG. 4 is a view comparable to FIG. 2 showing the parts in their position when the door panel is in fully open position.

If, however, there is a further manual opening of the door panel, then the slide 26 is further advanced as shown in FIG. 4 to a position in which several things occur. Because the spring 38 is relatively strong, the mushroom head 41 is advanced to the left against the wedge 51 and so advances the wedge or actuator rod 54 and the solenoid core 61 to abut the permanent magnet 68. This compresses the relatively weak spring 59. Any overtravel is accommodated by the opening 31. The washer 33 and end of the rod 34 move into the open space 31 and the spring 38 is compressed.

Assuming the door is to be held in open position, a usual circumstance, the permanent magnet 68 is sufficiently powerful to hold the solenoid core 61, as shown in FIG. 4, with the spring 59 compressed and with the wedge 51 between the adjacent lever ends. When the manual opening grasp of the door is released, the door can close slightly and enter the position illustrated in FIG. 5. The mushroom head 41 has shifted to the right slightly and lodges against the approached ends of the levers, kept from spreading by the wedge interposed at their other ends. This permits taking up of the lost motion in the space 31. The door panel 8 is thus held very nearly in its fully open position. The forces normally acting on the door panel are not large enough to dislodge any of the parts from the positions shown in FIG. 5. The permanent magnet acting on the end of the solenoid core is sufficient to retain the door in this nearly open position.

Figure 5:
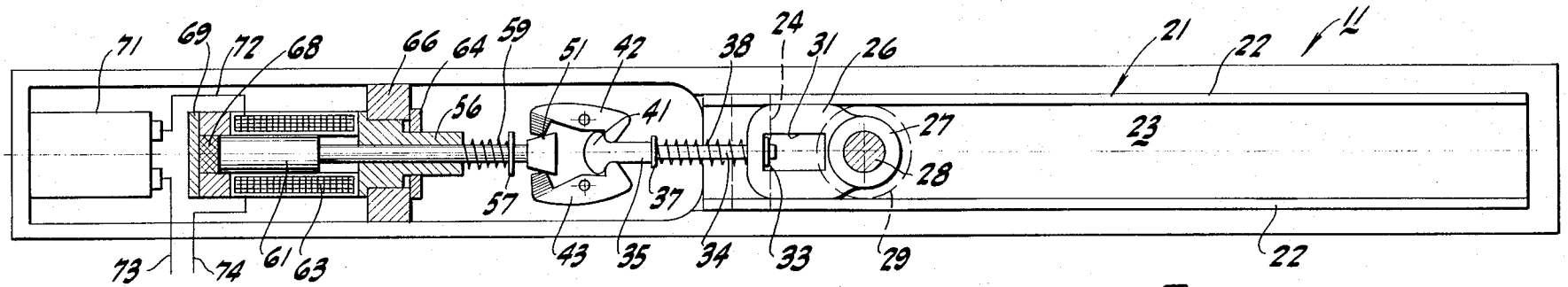
FIG. 5 is a view comparable to FIG. 2 with the door panel latched open but returned slightly from fully open position.

If, however, it is desired manually to move the door panel out of its nearly open position, a pull on the door handle will exert force to move the slide 26 toward the right in FIG. 5 and will cause the mushroom head 41 to cam against the right ends of the rocker or latch levers 42 and 43, thus spreading them apart. This is accompanied by sufficient force to cause the left ends of the levers to cam against the sides of the wedge and to drive the wedge rightward and so withdraw the solenoid core 61 from contact with the permanent magnet 68. The withdrawal force is sufficient so that the mushroom head 41 is completely removed from between the levers 42 and 43 and is moved through a position as shown in FIG. 3 into a position as shown in FIG. 2.

The door may be held in nearly open position, as shown in FIG. 5, indefinitely. Under some circumstances, however, it is desired to have an automatic release of the door panel even without any manual pull thereon. This may be true in case of fire, for example. A smoke detector or other control can be arranged to release the structure.

Although the permanent magnet 68 is powerful enough to hold the core 61 in its left-most position when the coil 63 is not energized, still when the coil 63 is energized the coil exerts sufficient electromagnetic effect to overcome or neutralize the effect of the permanent magnet to allow the spring 59 to translate the solenoid core 61 to the right. For this purpose, the frame 21 may carry a battery 71 or appropriate source of electromotive force connected by a conductor 72 to the coil 63. The battery also has a conductor 73 going to a point from which a return conductor 74 likewise connects to the coil 63. At the remote point there may be a manual switch, a switch actuated by a smoke detector, or any other suitable responsive device effective when actuated to close the circuit between the power source 71 and the coil 63.

Upon closure of the circuit to the coil 63 and energization of that coil, the attractive force of the permanent magnet 68 is reduced allowing the solenoid core 61 to be moved away from the magnet 68. Forces then effective to induce such movement include those due to the spring 59 and due to the closer mechanism 13 transmitted by the wedge 51 to the levers 42 and 43. The effect is to move the core 61 from a position as shown in FIGS. 4 and 5 into a position as shown in FIGS. 2, 3 and 6.

Figure 6:
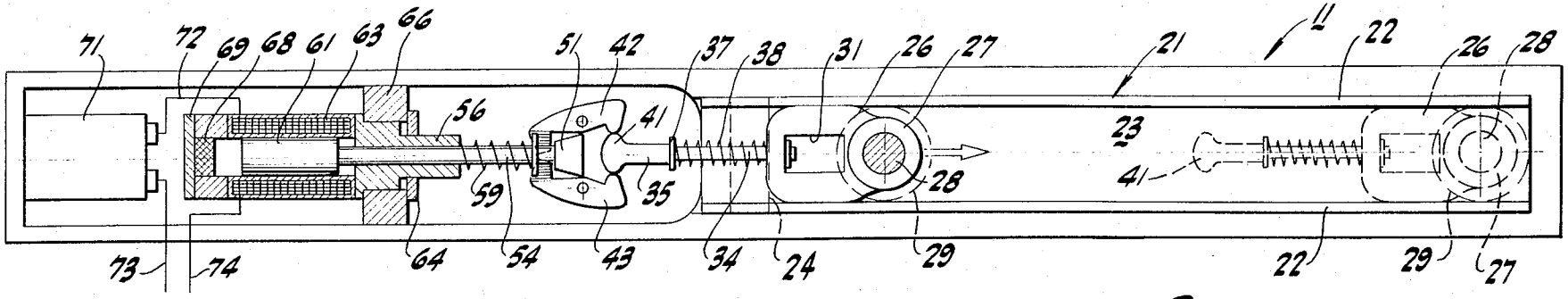
FIG. 6 is a view like FIG. 2 but showing the parts in a released condition with the door panel under sole control of the door closer or of manual operation.

Movement of the core 61 to the right, for example, as shown in FIGS. 5 and 6 permits the wedge 51 to move between the levers sufficiently to clear the left ends thereof and to permit the closer spring 50, exerting force on the mushroom head 41, to cam the head 41 against the right ends of the levers 42 and 43 and spread them apart so that the slider 26 is completely released. Under the influence of the spring 50 in the door closer mechanism 13, there is then effectuated an appropriately controlled closure of the door panel 8 restoring it to its shut position within the door frame.

With this arrangement, all of the customary door hold-open features are attained and with an often desirable quick release of the hold-open mechanism. There is no need, however, for continuous consumption of electricity during the hold-open period, and but a small, short use of electric current is required promptly to effect a release of the structure allowing the door panel to close. There may be but need not be any movable electric wiring between the door panel and the door frame, and the structure is easily accommodated in the usual mounting structures.

I claim:

1. A releasable hold-open device for a door closer interconnecting a door frame and a door panel movable relative to the door frame between closed and open positions comprising a spring for urging the panel toward said closed position, and comprising means movable in accordance with the movement of a door panel relative to said door frame, a follower movably joined to said movable means for only relative rectilinear motion therewith toward and away from a stop position, means on said movable means and on said follower for urging said follower toward said stop position, a latch engageable at one end with said follower and movable between a first position holding said follower in said stop position and a second position releasing said follower, an actuator directly engageable with another end of said latch and directly engageable with said follower and movable between one position holding said latch in said first position and another position free of said latch, means for resiliently urging said actuator toward said another position, a permanent magnet engageable with said actuator when said actuator is moved by direct engagement with said moving follower against said resilient urging means into said one position and having an effect to hold said actuator in said one position, an electromagnet effective when energized to overcome said effect of said permanent magnet and thereby releasing said door panel from being held in said open position and allowing the spring to urge the panel to the closed position.

2. A device as in claim 1 including a frame and in which said movable means is a slider adapted to reciprocate on said frame, said follower includes a mushroom head, and said latch includes a pair of latch levers each pivotally mounted on said frame and having cam ends engageable with said mushroom head.

3. A device as in claim 2, said actuator comprising a wedge, wherein said wedge is engageable with wedge followers on said latch levers.

4. A device as in claim 2, said permanent magnet having an effect to releasably hold said cam ends in engagement with said head.

* * * * *